US005839175A

United States Patent [19]

Lin

[11] Patent Number: 5,839,175

[45] Date of Patent: Nov. 24, 1998

[54] BUCKLING DEVICE WITH ELASTIC UNLOCKING CAPABILTY

[75] Inventor: Chih-Jay Lin, Tao-Yuan, Taiwan

[73] Assignee: Taiwan Industrial Fastner Corporation, Taipei, Taiwan

[21] Appl. No.: 858,569

[22] Filed: May 19, 1997

[30] Foreign Application Priority Data

Sep. 3, 1996 [TW] Taiwan ..... 85213553

[51] Int. Cl.[6] ..... A44B 11/00; A44B 11/25

[52] U.S. Cl. ..... 24/636; 24/191; 24/170

[58] Field of Search ..... 24/191, 170, 636, 24/633, 630, 629, 628

[56] References Cited

U.S. PATENT DOCUMENTS

| | | | |
|---|---|---|---|
| 2,862,268 | 12/1958 | Cushman | 24/636 X |
| 2,965,942 | 12/1960 | Carter | 24/170 |
| 3,212,151 | 10/1965 | Guerrero | 24/636 |
| 3,771,200 | 11/1973 | Hoch | 24/636 |
| 4,843,688 | 7/1989 | Ikeda | 24/191 X |
| 4,958,416 | 9/1990 | Frishling | 24/170 |
| 5,123,147 | 6/1992 | Blair | 24/636 |
| 5,172,455 | 12/1992 | Johnson et al. | 24/191 X |
| 5,181,280 | 1/1993 | Zachry, Jr. | 24/191 X |
| 5,269,050 | 12/1993 | Yewer, Jr. | 24/191 X |
| 5,561,891 | 10/1996 | Hseih | 24/191 X |
| 5,572,771 | 11/1996 | Kellegham | 24/191 X |
| 5,621,953 | 4/1997 | Fildan | 24/191 X |

*Primary Examiner*—Randolph A. Reese
*Assistant Examiner*—Robert J. Sandy
*Attorney, Agent, or Firm*—Bacon & Thomas, PLLC

[57] ABSTRACT

A buckling device used in conjunction with a strap for holding an object firmly in position is provided. The buckling device includes a male fastener and a female fastener. The male fastener includes a strap-mounting body for fixing a first end of the strap thereto and a tongue-like member formed on the strap-mounting body. The female fastener includes a rectangular body having a hollowed inside and formed with an insertion hole; a locking/releasing piece pivotally mounted on the rectangular body; and an elastic piece provided at the insertion hole. To engage, the tongue-like member on the male fastener is inserted into the insertion hole in the female fastener. The tongue-like member pressed on the elastic piece such that the elastic piece is bent downwards and thereby urges forcibly against the tongue-like member, thereby locking the tongue-like member in position in the female fastener and thus securely engages the male fastener with the female fastener. To disengage, the user can simply pull up the locking/releasing piece so that it is pivotally erected about the pivoting pins, thereby causing the tongue-like member to be ejected away from the locking position and out of the female fastener. The engagement and disengagement can be both carried out by the user quickly in just one step of operation.

7 Claims, 3 Drawing Sheets

BUCKLING DEVICE WITH ELASTIC UNLOCKING CAPABILTY

BACKGROUND OF THE INVENTION

1. Field of the Invention

This invention relates to buckling devices, and more particularly, to a buckling device used in conjunction with a strap or the like for buckling an object tightly in position by engaging a male fastener securely with a female fastener. This buckling device allows the engagement and disengagement of the male and female fasteners to be quickly done by the user in just one step of operation.

2. Description of Related Art

Buckling devices are a contrivance that includes a male fastener fixed to one end of a flexible and rugged strap or the like and a female fastener fixed to the other end of the same for holding something tightly in position by engaging the male fastener securely with the female fastener. Conventionally, the male fastener is engaged with the male fastener by means of locking a tongue-like member on the male fastener with a pivotable locking member on the female fastener. To engage, the tongue-like member on the male fastener is inserted into the female fastener, while the pivotable locking member is positioned in an unlocking state, and then the pivotable pivotable locking member locking member is pressed down to a locking position where the pivotable locking member securely fasten and lock the tongue-like member in position in the female fastener, thereby fastening the male fastener securely to the female fastener. To disengage, the user can pull the pivotable locking member up so as to draw it away from the locking position and thus allow the tongue-like member not to be locked from the pivotable locking member. This allows the male fastener to be disengaged from the female fastener.

One drawback to the foregoing buckling device, however, is that the engagement and disengagement of the male fastener and the female fastener both require the user to perform at least two steps of operation to achieve. To engage, the first step is to insert the tongue-like member into an insertion hole in the female fastener while the pivotable locking member is locked, and then the second step is to press down the pivotable locking member to forcibly lock the tongue-like member in position. To disengage, the first step is to pull up the pivotable locking member to unlock the tongue-like member, and then the second step is to pull the male fastener away from the female fastener by hand. The two-step engagement and disengagement will take much time and effort to complete. There exists, therefore, a need for a new buckling device which allows the engagement and disengagement of the male fastener and female fastener to be quickly done in just one step.

SUMMARY OF THE INVENTION

It is therefor a primarily objective of the present invention to provide a buckling device which has a male fastener and a female fastener that can be engaged with and disengaged from each other by the user quickly in just one step of operation.

In accordance with the foregoing and other objectives of the present invention, an improved buckling device is provided. The buckling device includes a male fastener and a female fastener which are fixed to the two ends of a strap or the like.

The male fastener includes a rectangular strap-mounting body for fixing a first end of the strap thereto and a tongue-like member formed on the strap-mounting body and with an engaging portion. The female fastener includes a body having a hollowed inside and formed with an insertion hole; a locking/releasing piece pivotally mounted on the body, the locking/releasing piece being formed with a handle portion of a user to operate the locking/releasing piece and a locking portion; an elastic piece, provided at the entrance defined by the insertion hole, the elastic piece being elastically bent when the tongue-like member is inserted into the insertion hole; and a strap-mounting bar, mounted inside the rectangular body, for fastening a second end of the strap thereto.

To engage the male fastener with the female fastener, the tongue-like member on the male fastener is inserted into the insertion hole in the female fastener. During the insertion, the tip of the tongue-like member presses on the elastic piece such that the elastic piece is bent downwards. After the tongue-like member is completely inserted through the insertion hole in position in the hollowed inside of the body of the female fastener, the elastic piece, which is now pressed down, upwardly urges forcibly by means of the elasticity thereof against the tip of the tongue-like member, causing the engaging portion to abut on the inner wall of the second body above the insertion hole of the female fastener. This locks the tongue-like member in position in the female fastener and thus securely engages the male fastener with the female fastener. At this time, the tip of the tongue-like member is urged forcibly on the bottom surface of the locking portion of the locking/releasing piece, thereby allowing the locking/releasing piece to be maintained firmly at the locking position.

To release (disengage) the male fastener from the female fastener, the user can simply pull up the locking/releasing piece so that it is pivotally erected about the pivoting pins formed on both sides of the locking/releasing piece. This causes the locking portion to be pressed down against the tip of the tongue-like member, which in turn presses down against the elastic piece. Owing to the curved surface on the tip of the tongue-like member, the tip of the tongue-like member can slide along the curved surface towards the bottom of the tongue-like member. This causes the engaging portion to be drawn away from the locking position on the inner wall of the body above the insertion hole of the female fastener. At this time, the elasticity of the elastic piece is exerted on the tip of the tongue-like member, thereby ejecting the tongue-like member out of the female fastener and thus disengaging the male fastener from the female fastener in just one step of operation.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENT

Figure 1:
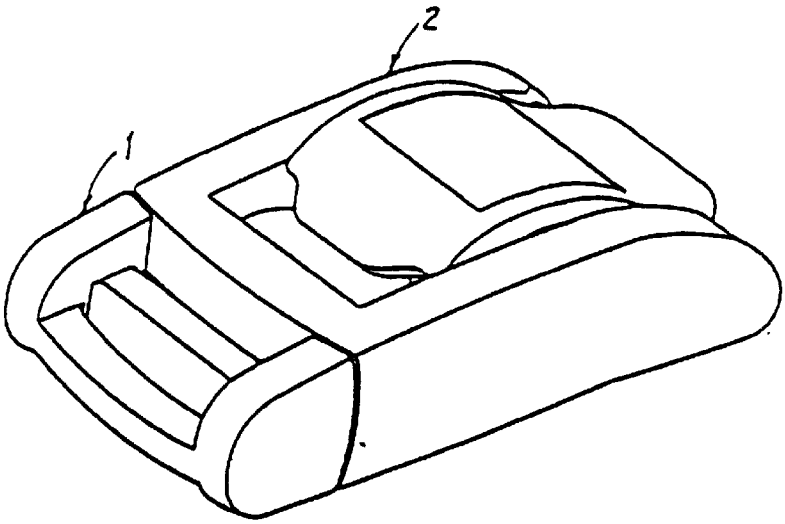
FIG. 1 is a perspective view of a buckling device whose male fastener and female fastener are engaged with each other.

Referring to FIG. 1, the buckling device includes a male fastener 1 and a female fastener 2 which can be quickly and easily engaged with and disengaged from the male fastener 1.

Figure 2:
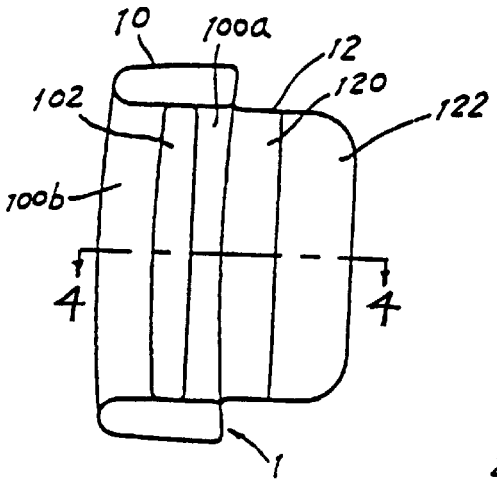
FIG. 2 is a top view of the male fastener.
Figure 5:
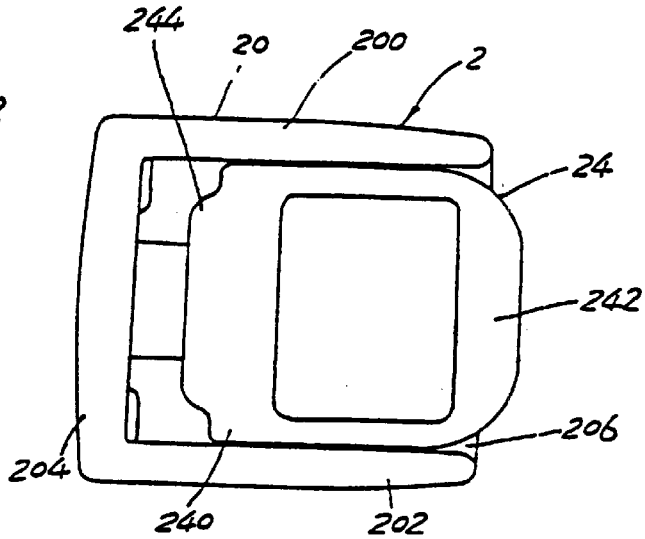
FIG. 5 is a top view of the female fastener.
Figure 3:
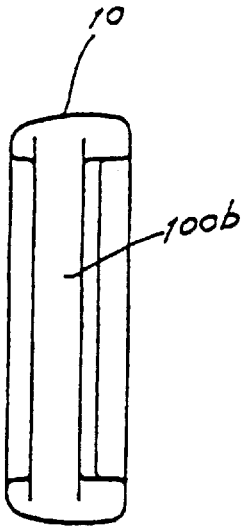
FIG. 3 is a front view of the male fastener.
Figure 6:
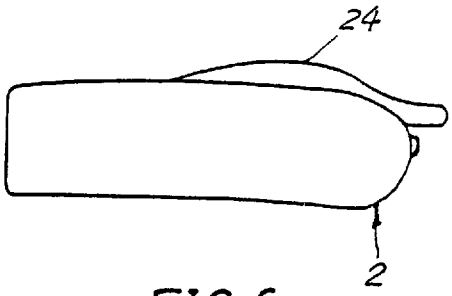
FIG. 6 is a side view of the female fastener.
Figure 4:
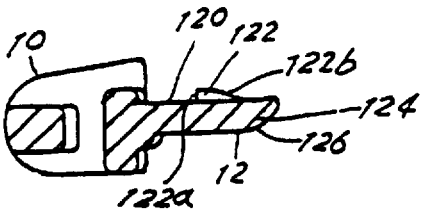
FIG. 4 is a sectional diagram of the male fastener of FIG. 2 cutting through the line 4—4.
Figure 7:
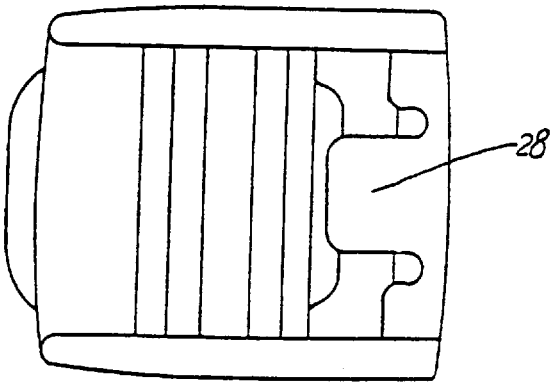
FIG. 7 is a bottom view of the female fastener.
Figure 8:
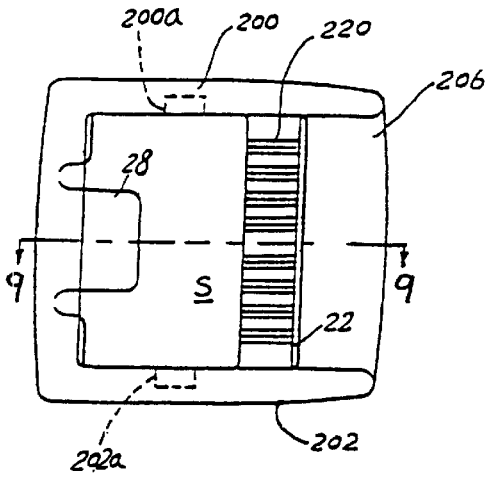
FIG. 8 is a bottom view of the female fastener with the dismounting of a locking/releasing piece.

Referring together to FIGS. 2 through 4, the male fastener 1 includes a rectangular strap-mounting body 10 to which a strap (not shown) or the like is fixed. Further, the male fastener 1 is formed with a tongue-like member 12 on a first bar 100*a* of the strap-mounting body 10. The strap-mounting body 10 is formed with a hollowed portion 102 which allows the strap to pass therethrough to be wound on a second bar 100*b* on the other side. The tongue-like member 12 has a top surface 120 formed with an engaging portion 122 which is a protruded portion on the top surface 120 extending along the longitudinal extending direction of the first bar 100*a* of the strap-mounting body 10. The engaging portion 122 has a vertical surface 122*a* erected in perpendicular to the top surface 120 of the tongue-like member 12 and an inclined surface 122*b*. Further, the tongue-like member 12 has a tip 124 formed with a curved surface 126.

Referring together to FIGS. 5 through 9, the female fastener 2 is a rectangular body 20 composed of a pair of parallel-spaced first plates 200, 202 and a pair of parallel-spaced second plates 204, 206. The first plates 200, 202 and the second plates 204, 206 in combination constitute a rectangular enclosure with a hollowed inside S. Near the second plate 206, a strap-mounting bar 22 is disposed in parallel with the second plates 204, 206, having both ends fixed respectively to the first plates 200, 202. The strap-mounting bar 22 is substantially triangle in cross section and formed with a plurality of protrusions 220 that can allow the strap (not shown) wound therearound to be more firmly secured. Further, the female fastener 2 includes a pivoted locking/releasing piece 24 pivotally connected at a pivot portion 240 to the rectangular body 20 of the female fastener 2. The locking/releasing piece 24 is shaped with a handle portion 242 on one side of the pivot portion 240 and a locking portion 244 on the other side of the same. A pair of pivoting pins 246 are provided on both sides of the pivot portion 240 of the locking/releasing piece 24 adjacent the first plates 200,202, which are inserted into corresponding holes 200*a*, 202*a* formed on the inner walls of the first plates 200, 202. This allows the locking/releasing piece 24 to be pivotally movable on the rectangular body 20 of the female fastener 2. An insertion hole 26 is formed in the second plate 204, which is used to receive the tongue-like member 12 on the male fastener 1 when the male fastener 1 is engaged with the female fastener 2. An elastic piece 28 is provided beneath the insertion hole 26 in the second plate 204. This elastic piece 28 is slightly angled upwards in such a manner that it blocks part of the insertion hole 26.

Figure 10:
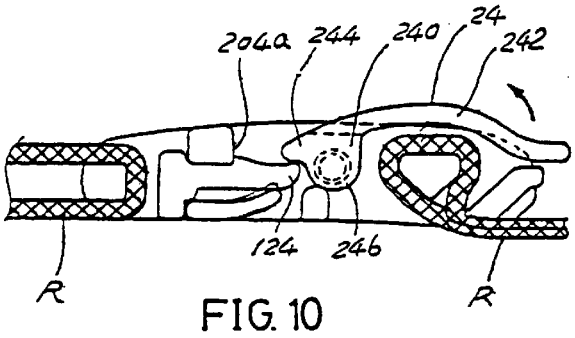
FIG. 10 is a schematic sectional diagram of the buckling device whose male fastener and female fastener are fixed to a strap.
Figure 9:
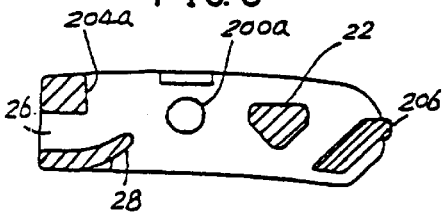
FIG. 9 is a schematic sectional diagram of the female fastener of FIG. 8 cutting through the line 9—9.
Figure 11:
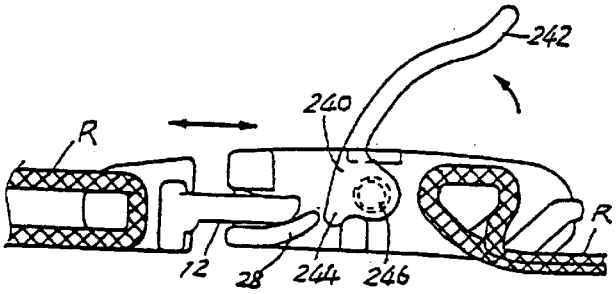
FIG. 11 is a schematic sectional diagram used to depict how the male and female fasteners are disengaged by pulling the movable plate upwards.

Referring to FIGS. 10 and 11, the buckling device is fixed to a strap R in such a manner that one end of the strap R is fastened to the strap-mounting body 10 of the male fastener 1 and the other end of the strap R is fastened to the strap-mounting bar 22 of the female fastener 2. This allows the buckling device along with the strap to serve as, for example, a fastening belt or the like, for securely covering the flap of a carrying bag to the body of the same.

To engage the male fastener 1 with the female fastener 2, the tongue-like member 12 on the male fastener 1 is inserted into the insertion hole 26 in the female fastener 2. During the insertion, the tip 124 of the tongue-like member 12 presses on the elastic piece 28 such that the elastic piece 28 is bent downwards. After the tongue-like member 12 is completely inserted through the insertion hole 26 in position in the hollowed inside S of the rectangular body 20, as illustrated in FIG. 10, the elastic piece 28, which is now pressed down, urges upwards forcibly against the tip 124 of the tongue-like member 12, causing the vertical surface 122*a* of the engaging portion 122 to abut on the inner wall 204*a* of the second plate 204 of the rectangular body 20 of the female fastener 2. This locks the tongue-like member 12 in position in the female fastener 2 and thus securely engages the male fastener 1 with the female fastener 2. At this time, the tip 124 of the tongue-like member 12 is urged forcibly on the bottom surface of the locking portion 244 of the locking/releasing piece 24, thereby allowing the locking/releasing piece 24 to be maintained firmly at the locking position. From the foregoing description, it is an apparent benefit of the invention that the male fastener 1 can be quickly engaged with the female fastener 2 in one step only without having to flip the locking/releasing piece 24.

Referring further to FIG. 11, to release the male fastener 1 from the female fastener 2, the user can simply pull up the locking/releasing piece 24 so that it is pivotally erected about the pivoting pins 246. This at the same time causes the locking portion 244 to be pressed down against the tip 124 of the tongue-like member 12, which in turn presses down against the elastic piece 28. Owing to the curved surface 126 on the tip 124 of the tongue-like member 12, the tip 124 of the tongue-like member 12 can slide along the curved surface 126 towards the bottom. This causes the engaging portion 122 to be drawn away from the locking position on the inner wall 204*a* of the second plate 204 to the insertion hole 26. At this time, the elasticity of the elastic piece 28 is exerted on the tip 124 of the tongue-like member 12, thereby ejecting the tongue-like member 12 out of the female fastener 2 and thus disengaging the male fastener 1 from the female fastener 2. From the forgoing description, it is an apparent benefit of the invention that the male fastener 1 can be quickly disengaged from the female fastener 2 in one step only.

In conclusion, the buckling device of the invention allows its male fastener and female fastener to be engaged with and disengaged from each other quickly in one step. This benefit allows, for example, users to quickly and easily an emergency by pulling up the locking/releasing piece.

The invention has been described using exemplary preferred embodiments. However, it is to be understood that the scope of the invention is not limited to the disclosed embodiments. On the contrary, it is intended to cover various modification and similar arrangements. The scope of the claims, therefore, should be accorded the broadest interpretation so as to encompass all such modifications and similar arrangements.

What is claimed is:

1. A buckling device used in conjunction with a strap for fastening an object in position, comprising:

a male fastener, which includes:

a strap-mounting body for fixing a first end of the strap thereto; and a tongue-like member formed on the strap-mounting body and with an engaging portion; and a female fastener for engaging with said male fastener, which includes:

a female fastener body having a hollowed inside and formed with an insertion hole;

a locking/releasing piece pivotally mounted on said female fastener body, said locking/releasing piece being formed with a handle portion for a user to operate said locking/releasing piece and a locking portion;

said tongue-like member being arranged to abut said locking portion, thereby maintaining said locking portion in a locking position;

an elastic piece, provided at an entrance defined by the insertion hole, said elastic piece being elastically bent when said tongue-like member is inserted into said insertion hole; and a strap-mounting bar, mounted inside said female fastener body, for fastening a second end of the strap thereto.

2. The buckling device of claim 1, wherein said tongue-like member has a tip formed with a curved surface.

3. The buckling device of claim 1, wherein said engaging portion of said tongue-like member is formed as a broad surface, the engaging portion including a vertical surface and an inclined surface, wherein the inclined surface extends outwardly from the broad surface and connects at its highest point with the broad surface by said vertical surface.

4. The buckling device of claim 3, wherein said tongue-like member further comprises a tip which abuts a bottom surface of the locking portion, thereby allowing said locking/releasing piece to thereby maintain said locking portion in a locking position.

5. The buckling device of claim 4, wherein said locking/releasing piece is arranged to pivot to cause said locking portion to be pressed against said tip of the tongue-like member and, in turn, said tongue-like member to press against said elastic piece, wherein as said engaging portion is withdrawn from said female fastener body, the elasticity of the elastic piece thus being exerted on said tip of said tongue-like member thereby ejects said tongue-like member out of said female fastener body.

6. The buckling device of claim 1, wherein said locking/releasing piece is further provided with a pair of pivoting pins for pivotally mounting said locking/releasing piece on said body of said female fastener.

7. The buckling device of claim 6 wherein said female fastener is formed with a pair of pivot holes for mounting said pivoting pins therein.

* * * * *